US011073031B2

(12) United States Patent
Keenan

(10) Patent No.: US 11,073,031 B2
(45) Date of Patent: Jul. 27, 2021

(54) BLADE FOR A GAS TURBINE ENGINE

(71) Applicant: ROLLS-ROYCE plc, London (GB)

(72) Inventor: Michael P. Keenan, Sheffield (GB)

(73) Assignee: ROLLS-ROYCE plc, London (GB)

( * ) Notice: Subject to any disclaimer, the term of this patent is extended or adjusted under 35 U.S.C. 154(b) by 73 days.

(21) Appl. No.: 16/234,047

(22) Filed: Dec. 27, 2018

(65) Prior Publication Data

US 2019/0218920 A1 Jul. 18, 2019

(30) Foreign Application Priority Data

Jan. 17, 2018 (GB) ..... 1800732.8

(51) Int. Cl.
*F01D 5/30* (2006.01)
*F01D 5/14* (2006.01)
*F04D 29/32* (2006.01)

(52) U.S. Cl.
CPC ..... *F01D 5/3038* (2013.01); *F01D 5/147* (2013.01); *F01D 5/3007* (2013.01); *F04D 29/322* (2013.01); *F05D 2250/73* (2013.01); *F05D 2260/941* (2013.01)

(58) Field of Classification Search
CPC ..... F01D 5/02; F01D 5/22; F01D 5/32; F01D 5/30; F01D 5/3007; F01D 5/141; F01D 225/70; F01D 5/3038; F01D 5/147; F05D 2240/30; F05D 2240/80; F05D 2240/60; F05D 2250/711; F05D 2250/712; F05D 2260/941; F05D 2230/10; F05D 2250/292; F05D 2250/73; F04D 29/322; F04D 29/34; F04D 29/38
See application file for complete search history.

(56) References Cited

U.S. PATENT DOCUMENTS 4,451,205 A * 5/1984 Honda ..... F01D 5/3007 416/219 R
5,511,945 A * 4/1996 Glezer ..... F01D 5/081 416/219 R
5,919,032 A 7/1999 Naudet et al.
7,442,007 B2 * 10/2008 Bibor ..... F01D 5/081 416/193 A
7,549,846 B2 * 6/2009 Dube ..... F01D 5/147 416/193 A
7,918,652 B2 * 4/2011 Fujimura ..... F01D 5/3015 416/219 R
2004/0253113 A1 12/2004 Lejars et al.
2012/0134834 A1 * 5/2012 Virkler ..... F01D 5/3007 416/219 R (Continued)

FOREIGN PATENT DOCUMENTS

EP 1 355 044 A2 10/2003
EP 1 749 968 A2 2/2007

(Continued)

OTHER PUBLICATIONS

Mar. 11, 2019 Search Report issued in European Patent Application No. 18212843.9.

(Continued)

*Primary Examiner* — J. Todd Newton, Esq.
*Assistant Examiner* — Eric J Zamora Alvarez
(74) *Attorney, Agent, or Firm* — Oliff PLC

(57) ABSTRACT

There is disclosed a blade for a gas turbine engine comprising an asymmetrical blade root.

15 Claims, 5 Drawing Sheets

(56) References Cited

U.S. PATENT DOCUMENTS

Figure 1:
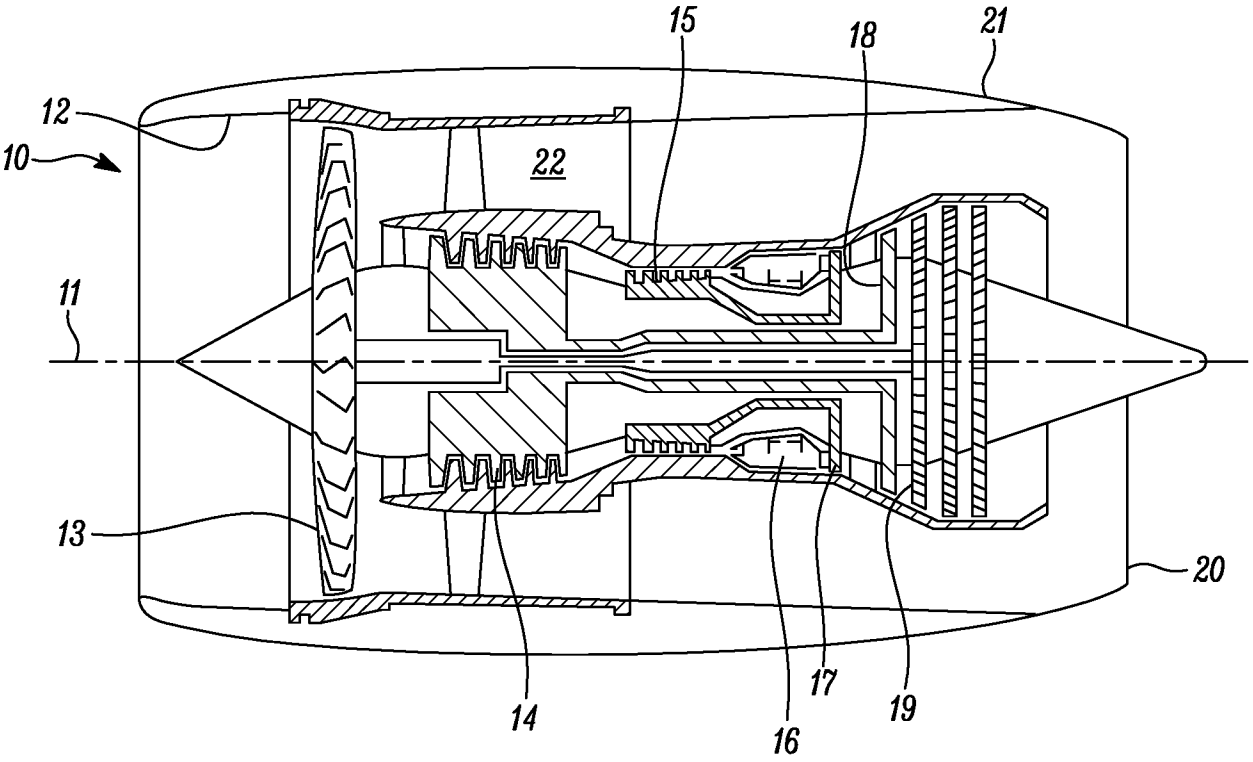

2016/0032739 A1* 2/2016 Sekihara ..... F01D 5/02
60/805

FOREIGN PATENT DOCUMENTS

| | | | |
|---|---|---|---|
| EP | 2 110 514 | A2 | 10/2009 |
| EP | 2 985 416 | A1 | 2/2016 |
| GB | 2 097 480 | A | 11/1982 |
| GB | 2 100 809 | A | 1/1983 |
| WO | 2017/209752 | A1 | 12/2017 |

OTHER PUBLICATIONS

Jul. 4, 2018 Search Report issued in British Application No. GB1800732.8.

* cited by examiner

BLADE FOR A GAS TURBINE ENGINE

The present disclosure relates to a blade for a gas turbine engine.

In a gas turbine engine, blades are typically mounted on a (rotor) disc of the gas turbine engine and extend generally radially from the disc. The disc is usually secured to a shaft of the gas turbine engine to allow rotation thereof (and of the blades) about a principal rotational axis of the gas turbine engine.

In conventional bladed disc arrangements, a series of circumferentially arranged blades are mounted to the rotor disc. This is typically achieved by providing the blade with a blade root which fits within a slot, e.g. a bedding flank, provided in the disc. The blade root and slot have cooperating shapes so as to appropriately transfer forces. The blade root is symmetrical about a first mid-plane which bisects the root and is parallel with a longitudinal direction of the slot, and a second mid-plane which bisects the root and is perpendicular to the longitudinal direction of the slot.

Whilst this arrangement may be satisfactory, it may be desirable to provide an improved arrangement.

According to an aspect there is provided a blade for a gas turbine engine comprising an asymmetrical blade root. The outer geometry, outer profile and/or general shape of the blade root may be asymmetrical. A lower surface of the blade root may be asymmetrical. Utilising an asymmetrical blade root may allow the outer geometry (or shape) of the blade root to be tailored to the particular loading conditions. For example, a region of the blade root which experiences higher forces may be designed to have a greater root depth than a region of the blade root which experiences lower forces. This may allow an optimal shape to be chosen which may allow the overall size (or volume) of the blade root to be reduced when compared to a conventional symmetrical blade root. This may allow the mass of an individual blade to be reduced.

The blade may comprise an aerofoil portion, a platform and a blade root. The aerofoil portion may extend radially outwardly from the platform. The blade root may extend radially inwardly from the platform.

The blade root may be asymmetrical about at least one mid-plane. The mid-plane may substantially bisect the blade root. The mid-plane may bisect the thickness (e.g. in an axial direction) and/or may bisect the width (e.g. in a circumferential direction) of the blade root.

The blade root may be asymmetrical about at least a mid-plane which, in use, is parallel with (and, e.g., includes) a longitudinal direction (or axis) of a slot (e.g. in a disc of the gas turbine engine) to which the blade root is fitted. The blade root may also or instead be asymmetrical about at least a mid-plane which, in use, is perpendicular to a longitudinal direction (or axis) of a slot (e.g. in a disc of the gas turbine engine) to which the blade root is fitted. This arrangement may improve the balance of the root.

The blade root may be asymmetrical about at least one of a first mid-plane which, in use, is parallel with (e.g. the longitudinal direction (or axis) of) a bedding flank of a disc of the gas turbine engine, and a second mid-plane which bisects the root and is perpendicular to (e.g. the longitudinal direction (or axis) of) a bedding flank of a disc of the gas turbine engine.

The longitudinal direction of the slot or bedding flank may be parallel with the engine axis or may be at an angle from the engine axis, e.g. an angle up to 30 degrees, e.g. 20 degrees, from the engine axis. This may be the case where the blade root (and slot) is of an "axial-type", as will be described further below.

The longitudinal direction of the slot or bedding flank may instead be (substantially) perpendicular to the engine axis. This may be the case where the blade root (and slot) is of a "circumferential-type", as will be described further below.

Thus, the blade root may be asymmetrical about at least a mid-plane which, in use, is parallel with and includes the engine axis. The blade root may be asymmetrical about at least a mid-plane which, in use, is at an angle from the engine axis, e.g. an angle of up to 30 degrees, e.g. 20 degrees, from the engine axis. The blade root may be asymmetrical about at least a mid-plane which, in use, is perpendicular to the engine axis. The blade root may be asymmetrical about a first mid-plane which, in use, is parallel with and includes the engine axis, and a second mid-plane which, in use, is perpendicular to the engine axis. This arrangement may improve the balance of the root.

The blade root may have an outer profile which is asymmetrical about the at least one mid-plane. The blade root may have a lower (e.g. radially inward facing) surface, which is asymmetrical about the at least one mid-plane. The blade root may have a contact surface which is asymmetrical about the at least one mid-plane.

The blade root may have first and second corresponding regions (e.g. on corresponding surfaces of the blade root) on opposite sides of the at least one mid-plane which have different average root depths. By "corresponding regions" it is meant that they are located at the same positions but on opposite sides of the mid-plane (i.e. at mirror image positions).

The first region may be configured to experience a higher stress than the second region. The first region may have an average root depth that is greater than that of the second region.

The first region may be on a side of the mid-plane that is configured to experience a greater load than the other side of the mid-plane (to which the second region belongs). The first region may have an average root depth that is greater than that of the second region.

The average root depths at the first and second corresponding regions of the blade root may differ by any suitable and desired amount. There may be an asymmetrical variation in blade root depth of at least 5%, at least 7%, at least 10%, at least 12% or at least 15%. The variation may be with respect to the maximum root depth.

The blade may be a compressor blade, a turbine blade or a fan blade.

There may also be provided a rotor disc assembly comprising a disc and one or more blades in accordance with any statement herein.

According to another aspect, there is provided a gas turbine engine comprising one or more blades in accordance with any statement herein or a rotor disc assembly in accordance with any statement herein.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

Figure 2:
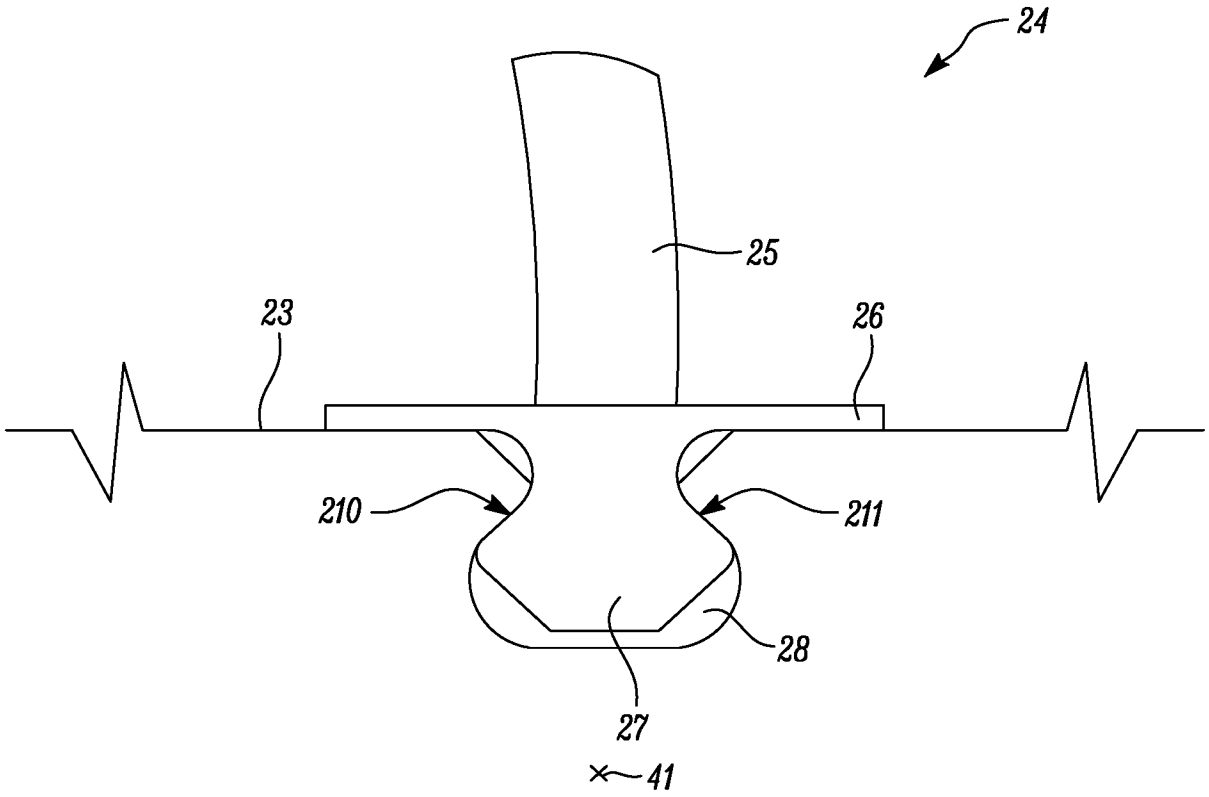
Figure 3:
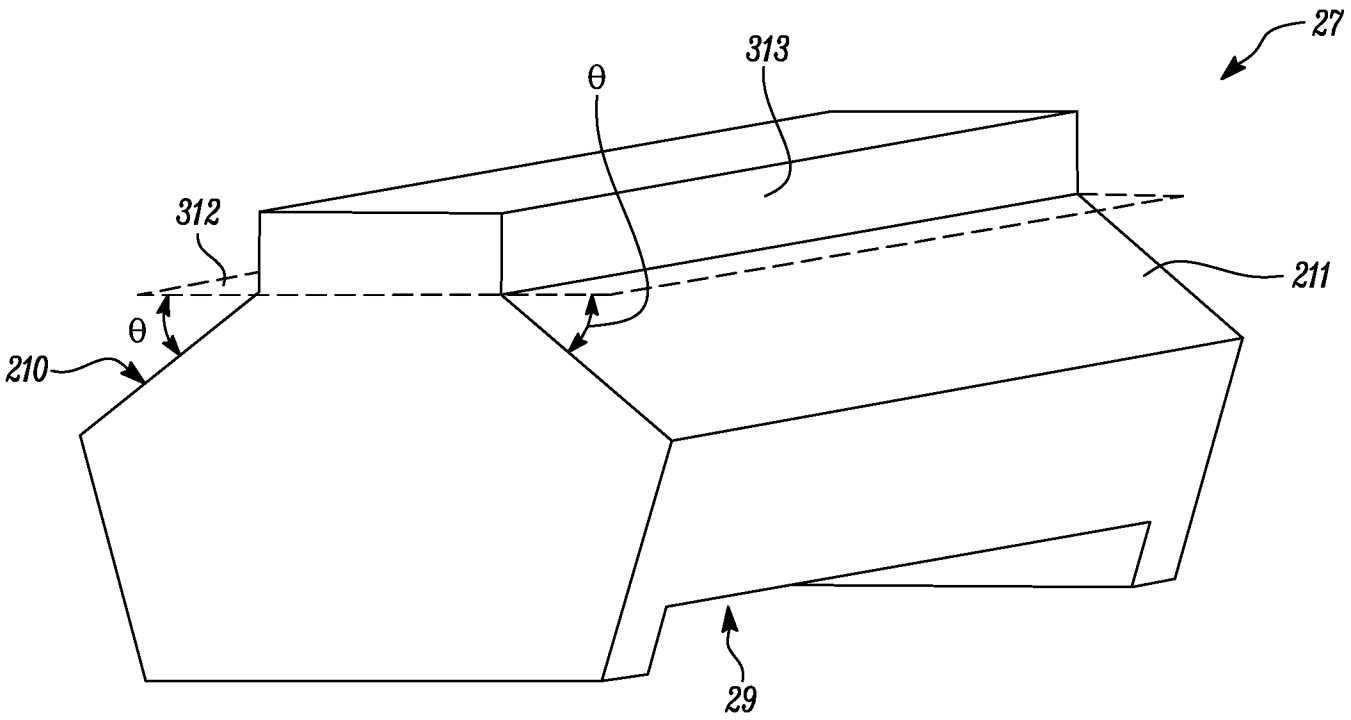
Figure 4:
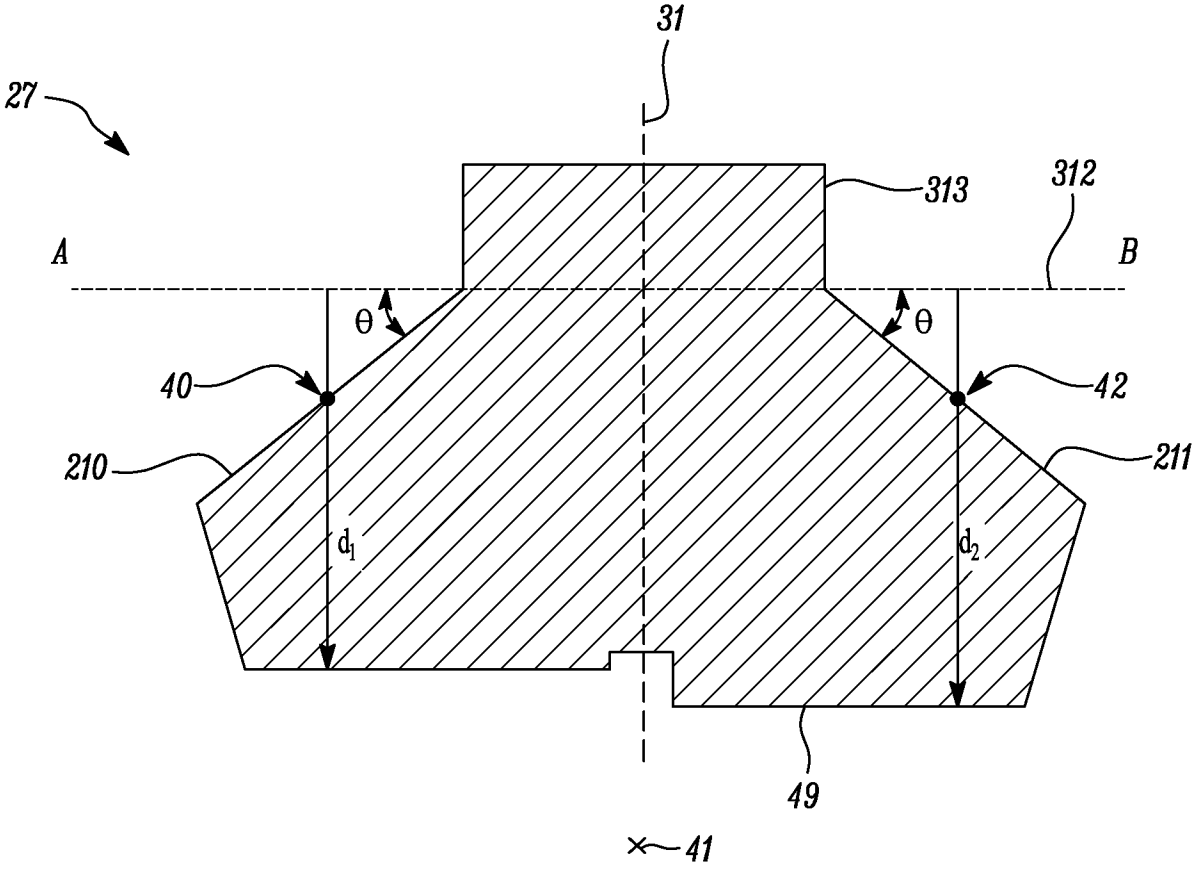
Figure 5:
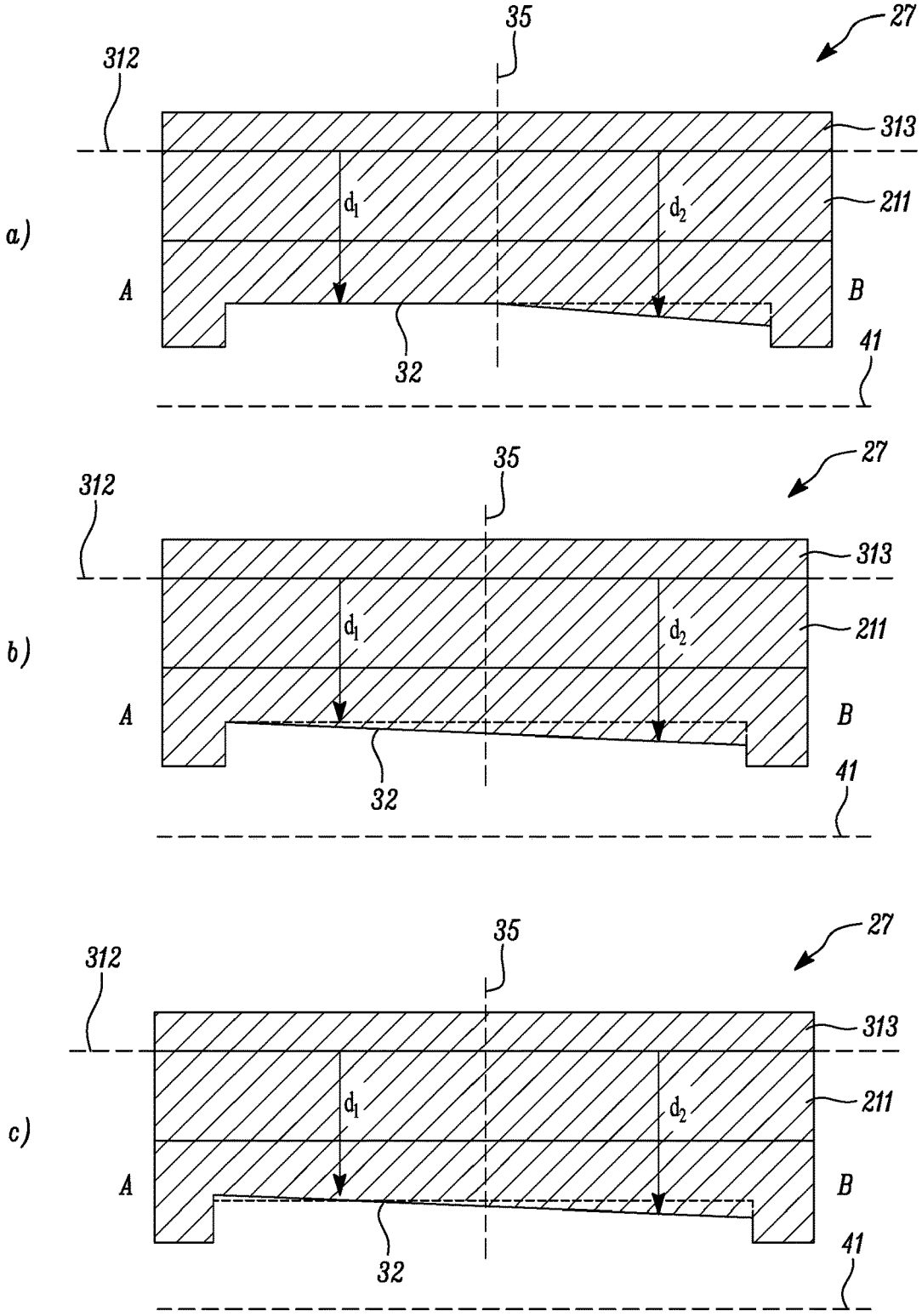

Embodiments will now be described by way of example, with reference to the accompanying drawings, in which:

FIG. 1 schematically shows a gas turbine engine;

FIG. 2 schematically shows a portion of a compressor assembly of a gas turbine engine, in accordance with a previously considered arrangement;

FIG. 3 is a schematic, three-dimensional view of a blade root, in accordance with a previously considered arrangement;

FIG. 4 schematically shows a cross-sectional view of a blade root, in accordance with the present disclosure; and FIG. 5 schematically shows three alternative cross-sectional view of a blade root, in accordance with the present disclosure.

With reference to FIG. 1, a gas turbine engine is generally indicated at 10, having a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, an intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted.

The resultant hot combustion products then expand through, and thereby drive the high, intermediate and low-pressure turbines 17, 18, 19 before being exhausted through the nozzle 20 to provide additional propulsive thrust. The high 17, intermediate 18 and low 19 pressure turbines drive respectively the high pressure compressor 15, intermediate pressure compressor 14 and fan 13, each by suitable interconnecting shaft.

Other gas turbine engines to which the present disclosure may be applied may have alternative configurations. By way of example such engines may have an alternative number of interconnecting shafts (e.g. two) and/or an alternative number of compressors and/or turbines. Further the engine may comprise a gearbox provided in the drive train from a turbine to a compressor and/or fan.

Each of the intermediate 14 and high 15 pressure compressors comprises a plurality of circumferentially arranged and radially extending compressor blades attached to one or more rotors in the form of compressor discs. Each compressor has at least one disc but may have two or more discs as appropriate.

Similarly, each of the high 17, intermediate 18, and low 19 pressure turbines comprises a plurality of circumferentially arranged and radially extending turbine blades arranged in one or more turbine discs. Each turbine has at least one disc, but may have two or more discs. Typically the high 17 and intermediate 18 pressure turbines have a single disc, while the low 19 pressure turbine has multiple discs.

Referring to FIG. 2, which shows a previously considered arrangement, a compressor blade 24 comprises an aerofoil portion 25, a platform 26 and a root 27. The blade 24 is generally radially extending with the aerofoil portion 25 radially extending outwards from the platform 26 and the blade root 27 radially extending inwards from the platform 26. As shown, the compressor blade 24 is attached to the compressor disc 23 by locating the blade root 27 and securing it within a slot 28 provided in the compressor disc 23. The blade root 27 extends in a longitudinal direction 41 of the slot 28. The blade root 27 may be an "axial-type" blade root 27 in that it engages an axially extending slot 28 provided at the outer periphery of the disc 23. In other arrangements, however, the blade root 27 may be a "circumferential-type" blade root 27 in that it engages a circumferentially extending slot 28 provided at the outer periphery of the disc 23. The slot 28 is shaped so as to receive the root 27 of the blade 24 and the root 27 engages the slot 28. As will be appreciated, during use forces are transferred between the root 27 and slot 28 via contact surfaces 210, 211 of the blade root 27.

FIG. 3 shows a schematic, three-dimensional view of a previously considered blade root 27. As can be seen in FIG. 3, the blade root 27 comprises a neck portion 313, which may extend radially inwards from a platform of the blade (not shown). The contact surfaces 210, 211 are each disposed at an angle, e, with respect to a plane 312 which intersects the blade root 27 at the points between the neck 313 and the angled contact surfaces 210, 211 of the blade root 27, as shown.

With reference to both FIGS. 2 and 3, the blade root 27 is generally symmetrical about two mid-planes. In particular, the blade root 27 is symmetrical about a first mid-plane that bisects the root 27 and is perpendicular to the slot direction 41 and is also symmetrical about a second mid-plane that bisects the root 27 and is parallel with the slot direction 41.

FIG. 4 shows a transverse, cross-sectional view of an asymmetrical blade root 27 in accordance with an embodiment of the present disclosure. The cross-section in FIG. 4 was taken across the centre of the blade root 27 in its longitudinal direction 41.

The blade root arrangement of FIG. 4 is similar to those of FIGS. 2 and 3 in that the root 27 comprises a neck portion 313 and contact surfaces 210, 211 that are disposed at an angle θ from a plane 312 which is at the intersection between the neck portion 313 and the contact surfaces 210, 211. However, the root 27 of FIG. 4 differs from those of FIGS. 2 and 3 in that it is asymmetrical, as will now be discussed.

As can be seen in FIG. 4, the blade root 27 is asymmetrical about a mid-plane 31 that bisects the blade root 27 and which is parallel to the longitudinal direction 41 of the slot to which the root 27 is fitted, in use. Where the blade root 27 is an "axial-type" blade root, the mid-plane 31 is parallel to and includes the engine axis (or is at a non-perpendicular angle thereto). However, it will be appreciated that where the blade root is a "circumferential-type" blade root 27, the mid-plane 31 (and slot direction 41) would be perpendicular to the engine axis 11. The mid-plane 31 bisects the blade root 27 such that the distance along the normal from the mid-plane 31 to the furthest edge of the blade root 27 is the same on both sides of the mid-plane 31. The mid-plane 31 also bisects the blade root 27 such that the distance along the normal from the mid-plane 31 to the edge of the neck portion 313 is the same on both sides of the mid-plane 31.

The blade root 27 is asymmetrical inasmuch as the general overall shape, i.e. the general outer profile, is asymmetrical. Designing the blade root 27 to be asymmetrical allows those portions of the root 27 which experience higher forces in use to have a corresponding root depth that is greater than those portions of the root 27 which experience lower forces. This may allow the geometry of the blade root 27 to be more appropriately tailored to the forces it experiences. This may therefore allow the overall size of the root to be reduced when compared to a conventional symmetrical root. The blade root 27 may be symmetrical or asymmetrical about a second mid-plane that is perpendicular to the longitudinal direction 41 of the slot.

As shown in FIG. 4, the outer profile of the blade root 27 is non-symmetrical. In particular, the root 27 has a lower surface 49, the profile of which is asymmetrical about the mid-plane 31. This means that the root depth d, measured from the plane 312, varies asymmetrically. In the arrangement shown in FIG. 4, the load from the aerofoil and the mass of the blade root 27 is greater on side B than side A of the mid-plane 31, and accordingly the geometry of the blade root 27 is designed to accommodate for this. In particular, the root depth d2 corresponding to a, e.g. high-stress, region or point 42 on side B is greater than the root depth d1 of a corresponding, e.g. low-stress, region or point 40 on side A so as to support the higher load. Point 40 and point 42 are at corresponding positions on contact surfaces 210 and 211, respectively, but on opposing sides of the mid-plane 31 (i.e. they are at mirror image positions). The root depth d2 may differ from d1 by an amount equal to around 10% of the maximum depth of the blade root 27. Of course, other suitable values may be chosen depending on the circumstances and loading forces experienced. In this arrangement the lower surface 49 of the blade root 27 varies in a step-wise manner. However it will be appreciated that the root depth may vary in other forms such as in a tapered manner or there may be a curvature to the lower surface 49 of the blade root 27.

FIG. 5 shows further asymmetrical blade root 27 arrangements (a), (b) and (c). The dotted line shown on the root 27 in FIG. 5 is the nominal lower surface of the root 27 (i.e. without any asymmetry). The overall outer geometry (or profile) of blade root 27 is asymmetrical about a mid-plane 35 that bisects the blade root 27 and which is perpendicular to the longitudinal direction 41 of the slot, in use. Where the blade root 27 is an "axial-type" blade root, as is the case in the arrangements shown in FIG. 5, the mid-plane 35 is perpendicular to the engine axis 11 shown in FIG. 1. However, where the blade root is a "circumferential-type" blade root, the mid-plane 35 may be parallel to and include the engine axis 11.

As shown in FIG. 5, the blade root 27 comprises a lower surface 32 on the underside of the blade root 27 and the root depth d of the blade root 27 varies asymmetrically about the mid-plane 35. In the arrangement of FIG. 5, the blade root 27 is exposed to higher forces on side B of the mid-plane 35 than side A of the mid-plane 35 and accordingly the geometry of the blade root 27 in corresponding regions on the opposing sides A, B of the mid-plane 35 is designed to accommodate for this. Specifically, the average root depth d2 corresponding to a high-stress region on side B is greater than the average root depth d1 of a corresponding low-stress region on side A.

In the arrangements illustrated in FIG. 5 there is a tapered increase in the blade root depth d (i.e. the underside of the blade root 27 tapers). FIG. 5(*a*) shows an arrangement in which the taper of the lower surface 32 starts at the mid-plane 35. FIG. 5(*b*) shows an arrangement in which the taper of the lower surface 32 extends across the width of the lower surface 32. FIG. 5(*c*) shows an arrangement in which the taper of the lower surface 32 extends across the width of the lower surface and in which the low-stress region on side A has a root depth d1 less than the nominal root depth (shown in dotted line). It will be appreciated that in all of these arrangements the taper has the effect of creating an asymmetrical blade root. It will be appreciated that the degree of the taper and the precise variation in root depth will depend on the particular application and the expected loading conditions.

In the aforementioned arrangements it has been described that the blade root 27 is asymmetric about a single plane. However, if should be appreciated that the blade root 27 could be asymmetric about multiple planes. For example, the blade root 27 could be asymmetric about a first mid-plane 31 that bisects the blade root 27 and is parallel to the longitudinal direction 41 of the slot (e.g. parallel to the engine axis 11), and asymmetric about a second mid-plane 35 that bisects the blade root 27 and is perpendicular to the longitudinal direction 41 (e.g. perpendicular to the engine axis 11).

It will also be appreciated that although the root depth is described with respect to a measurement from the plane 312 of the blade root 27, this is not required. The root depth may be measured in any suitable or desired manner, e.g. from a platform of the blade root 27.

It has been described that the asymmetrical blade root is the blade root of a compressor blade. However, it should be noted that any suitable blade (e.g. a turbine blade) could be provided with an asymmetrical blade root.

It will be understood that the technology described herein is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A blade for a gas turbine engine comprising an asymmetrical blade root, wherein the blade root is asymmetrical about a mid-plane that bisects the blade root perpendicular to a longitudinal direction of a slot to which the blade root is configured to fit, a depth of the blade root is the same on opposite ends of the blade root in the longitudinal direction, and a portion of a lower surface includes a tapered increase of a depth of the blade root along the longitudinal direction.

2. The blade as claimed in claim 1, wherein the blade root is asymmetrical about a mid-plane parallel with the longitudinal direction of the slot to which the blade root is configured to fit.

3. The blade as claimed in claim 1, wherein the blade root is asymmetrical about at least a mid-plane parallel with and including an engine axis.

4. The blade as claimed in claim 1, wherein the blade root is asymmetrical about at least a mid-plane perpendicular to an engine axis.

5. The blade as claimed in claim 1, wherein the blade root has an outer profile which is asymmetrical about the mid-plane.

6. The blade as claimed in claim 1, wherein the lower surface is asymmetrical about the mid-plane.

7. The blade as claimed in claim 1, wherein the blade root has first and second corresponding regions on opposite sides of the mid-plane which have different average root depths.

8. The blade as claimed in claim 7, wherein the first region is configured to experience a higher stress than the second region; and the first region has an average root depth that is greater than that of the second region.

9. The blade as claimed in claim 1, wherein there is an asymmetrical variation in blade root depth of at least 5%, at least 7%, at least 10%, at least 12% or at least 15%.

10. The blade as claimed in claim 1, wherein the blade is a compressor blade, a turbine blade or a fan blade.

11. A rotor disc assembly comprising a disc and at least one blade as claimed in claim 1.

12. A gas turbine engine comprising the blade as claimed in claim 1.

13. A gas turbine engine comprising the rotor disc assembly as claimed in claim 11.

14. The blade according to claim 1, wherein the tapered increase is continuous.

15. The blade according to claim 1, wherein the tapered increase is continuous on opposite sides of the mid-plane.

* * * * *